United States Patent [19]

Suzuki et al.

[11] Patent Number: 4,886,436

[45] Date of Patent: Dec. 12, 1989

[54] LUBRICATING ARRANGEMENT FOR A SHAFT SEAL IN A VANE TYPE COMPRESSOR

[75] Inventors: Shigeru Suzuki; Katsuhiko Ohshiro; Ichiro Kasugai, all of Kariya, Japan

[73] Assignee: Kabushiki Kaisha Toyoda Jidoshokki Seisakusho, Aichi, Japan

[21] Appl. No.: 241,358

[22] Filed: Sep. 7, 1988

[30] Foreign Application Priority Data

Sep. 12, 1987 [JP] Japan ..... 62-229185

[51] Int. Cl.[4] ..... F01C 21/04; F04C 29/02

[52] U.S. Cl. ..... 418/100; 418/102

[58] Field of Search ..... 418/100, 102, 104

[56] References Cited

U.S. PATENT DOCUMENTS

| | | | |
|---|---|---|---|
| 3,656,875 | 4/1972 | Luck | 418/100 X |
| 3,899,271 | 8/1975 | Glanvall | 418/102 X |
| 4,484,868 | 11/1984 | Shibuya et al. | 418/100 X |
| 4,743,183 | 5/1988 | Irie et al. | 418/100 X |

FOREIGN PATENT DOCUMENTS

| | | | |
|---|---|---|---|
| 52596 | 5/1981 | Japan | 418/100 |
| 228792 | 11/1985 | Japan | 418/100 |

*Primary Examiner*—Michael Koczo

*Attorney, Agent, or Firm*—Burgess, Ryan & Wayne

[57] ABSTRACT

A vane type compressor comprising a main housing with a cylinder, a front side plate covering one end of the cylinder, a front housing over the front side plate for forming a suction chamber, and a rotor inserted in the cylinder with a rotatable drive shaft extending through bosses of the front side plate and the front housing. A seal is arranged in the boss of the housing, and a check valve is arranged in the front housing at the inlet thereof. To guide the fluid in the suction chamber to the seal, to improve the lubrication of the seal, a pair of guide walls are provided on opposite sides of the check valve and between the check valve and the suction ports to constitute a passage directed to the seal. Also, a pair of ribs is extended from the front side plate toward the seal to constitute a gap, the gap overlapping the passage.

7 Claims, 4 Drawing Sheets

LUBRICATING ARRANGEMENT FOR A SHAFT SEAL IN A VANE TYPE COMPRESSOR

FIELD OF THE INVENTION

The present invention relates to an improved lubricating arrangement for a seal on a rotatable drive shaft in a vane type compressor. More specifically, it relates to an improved lubricating arrangement in a vane type compressor in which a seal is arranged between the outer surface of a rotatable drive shaft and the inner surface of a central boss of a front housing and is intended to be lubricated by a lubricant contained in a fluid to be compressed, which is admitted into a suction chamber through an inlet check valve arranged therein.

DESCRIPTION OF THE RELATED ART

A typical vane type compressor including a seal on a rotatable drive shaft for sealing a suction chamber and a check valve at an inlet in the suction chamber is shown in FIGS. 3 and 4 in the attached drawings. Such a vane type compressor comprises a main housing or a rear housing 5 including a cylinder 1 therein, a front side plate 2 covering one end of the cylinder bore, and a front housing 4 constituting a suction chamber 3 between the front side plate 2 and the front housing 4. A rotor 7 with radial vanes 6 is inserted in the cylinder 1 and secured on a rotatable drive shaft 8, and a shaft seal mechanism 9 is provided between the outer surface of the rotatable drive shaft 8 and the inner surface of a central boss 4*a* of the front housing 4 to seal the suction chamber 3 from the exterior of the compressor. Two suction ports 11 and 12 (shown by a semibroken line in FIG. 3) are provided in the front side plate 2 symmetrically about the rotating drive shaft 8, for an admission of fluid from the suction chamber 3 into the cylinder bore, i.e., the compression working chamber 10. Also, an inlet 4*b* is provided in the front housing 4 at a peripheral region thereof for an admission of fluid from the exterior of the compressor into the suction chamber 3, with a check valve 13 arranged therein to prevent a back flow of the fluid.

In such a vane type compressor, the check valve 13 comprises a tubular valve body 15 extending radially inward in the suction chamber 3 and valve ports 15*a* laterally open through the tubular hollow wall of the tubular valve body 15. This arrangement allows a majority of the fluid admitted through the valve ports 15*a* into the suction chamber 3 to flow generally directly to the suction ports 11 and 12, as shown by the arrows, and causes less fluid to flow toward the shaft seal mechanism 9. Therefore, the amount of the lubricant-containing fluid supplied to the shaft seal mechanism 9 is reduced, to decrease the lubrication of the shaft seal mechanism 9, and thus the temperature of the shaft seal mechanism 9 is increased and an undesirable hardening or cracking of a seal element of an organic material may occur, to reduce the sealing property.

SUMMARY OF THE INVENTION

The object of the present invention is to solve the above described problems and to provide an improved lubricating arrangement for a seal on a rotatable drive shaft in a vane type compressor, to increase the lubrication and reliability of the shaft seal.

According to the present invention, there is provided a vane type compressor comprising: a main housing having a cylinder with a cylinder bore formed therein; a front side plate covering one end of the cylinder bore, the front side plate having a central boss and at least one suction port for an admission to the cylinder bore of a fluid to be compressed; a front housing mounted on the main housing at one end thereof over the front side plate and forming a suction chamber between the front housing and the front side plate, the front housing having an end wall with a central boss and a peripheral wall with an inlet formed therethrough for an admission of the fluid from the exterior of the compressor into the suction chamber; a rotor inserted in the cylinder bore and secured on a rotatable shaft, the rotatable shaft extending through the central boss of the front side plate and the central boss of the front housing; a check valve arranged in the front housing at the inlet to prevent a flow of the fluid from the suction chamber to the exterior of the compressor; a seal arranged in the central boss of the front housing around the rotatable shaft for sealing the suction chamber; and a guide wall means provided in the suction chamber for guiding the fluid from the check valve toward the seal.

With this arrangement, a majority of the fluid admitted from the exterior of the compressor through the check valve into the suction chamber is first guided to the seal, so that the seal can be fully lubricated by the misty lubricant contained in the fluid to be compressed, and as a result, the lubrication of the seal is improved and an undesirable hardening or cracking of a seal element of an organic material is prevented or reduced, and thus the reliability of the seal is raised.

BRIEF EXPLANATION OF THE DRAWINGS

The other objects and features of the present invention will become more apparent from the following description of the preferred embodiment with reference to the attached drawings, in which.

DESCRIPTION OF THE PREFERRED EMBODIMENT

Figure 1:
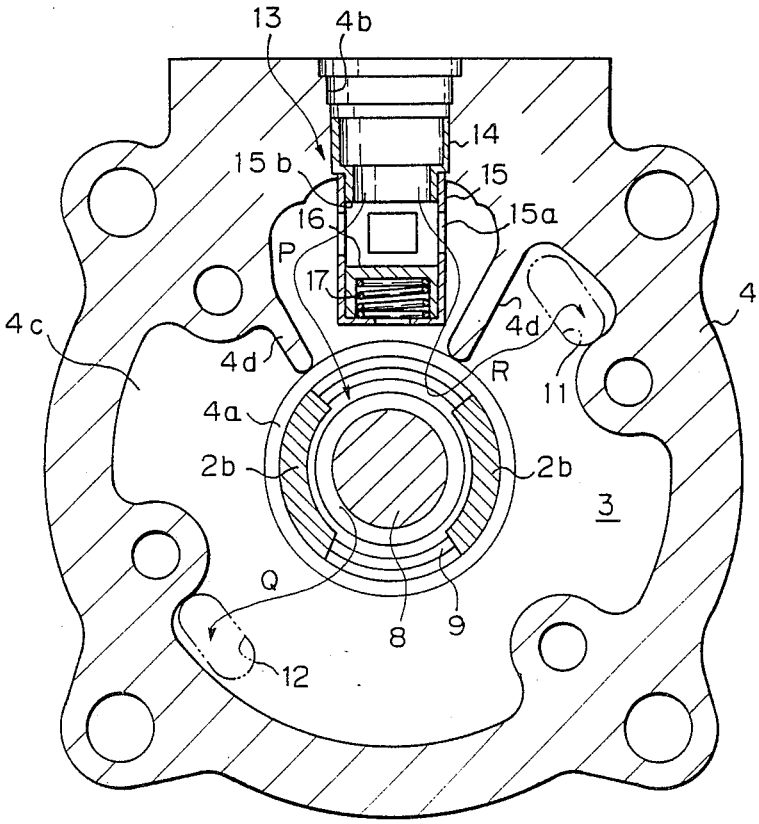
FIG. 1 is a cross sectional view of a vane type compressor according to the present invention, taken along the line A—A in FIG. 2.
Figure 2:
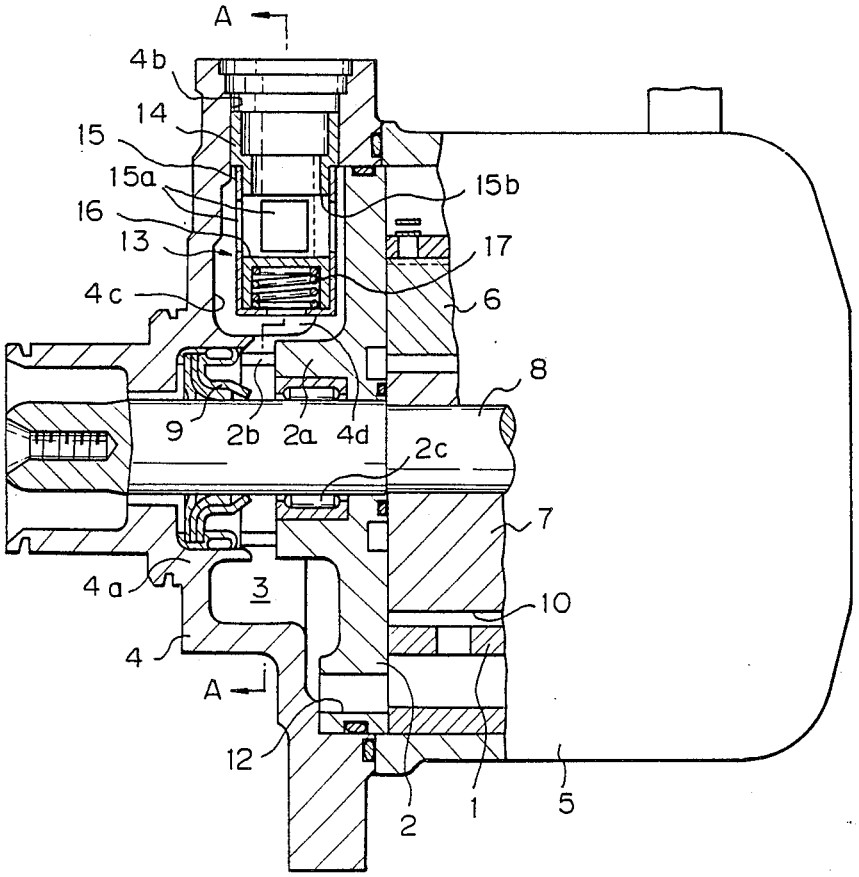
FIG. 2 is a longitudinal sectional view of the vane type compressor in FIG. 1.
Figure 3:
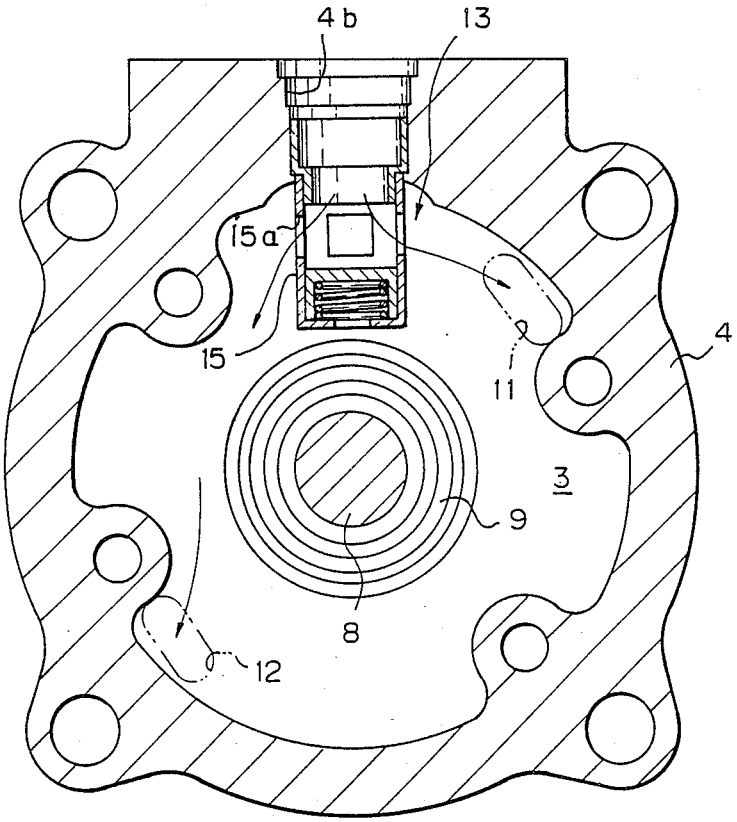
Fig. 3 PRIOR ART
FIG. 3 is a cross sectional view of a vane type compressor of a prior art, taken along the line B—B in FIG. 4.
Figure 4:
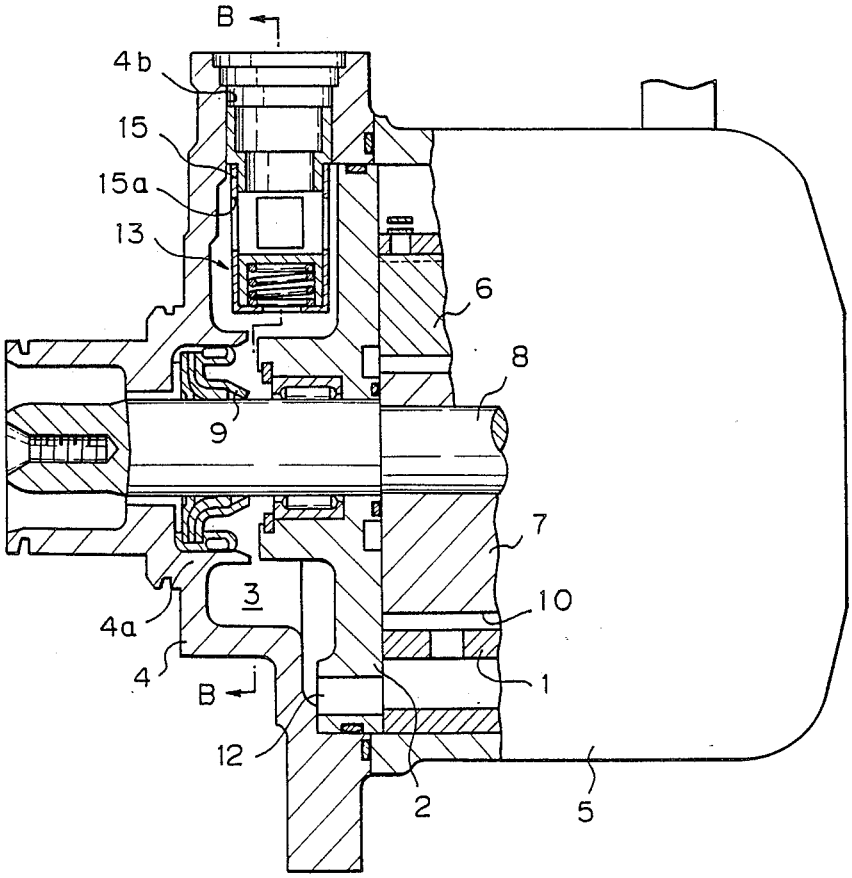
Fig. 4 PRIOR ART
FIG. 4 is a longitudinal sectional view of the vane type compressor in FIG. 3.

In FIGS. 1 and 2, elements similar to those in FIGS. 3 and 4 are represented by the same reference numerals, to clarify the description.

The vane type compressor according to the present invention comprises a main housing or a rear housing 5 including a cylinder 1 with an oblong cylinder bore therein, a front side plate 2 covering one end of the cylinder bore, and a front housing 4 constituting a suction chamber 3 between the front side plate 2 and the front housing 4. A rear side plate can be arranged in the rear housing 5 to cover the other end of the cylinder bore, but is not shown in the drawing since the present invention relates mainly to the front portion of the compressor. A rotor 7 with radial vanes 6 is inserted in the cylinder 1 and secured on a rotatable drive shaft 8.

The front side plate 2 has a central boss 2*a* and two suction ports 11 and 12 (shown by a semibroken line in FIG. 1) arranged symmetrically about the rotating drive shaft 8 for an admission of fluid from the suction chamber 3 into the cylinder bore, i.e., the compression working chamber 10 between the adjacent vanes 6. Also, the front housing 4 has an end wall with a central boss 4*a*, and a peripheral wall. An inlet 4*b* is provided in the front housing 4 at the peripheral wall thereof for an admission of fluid from the exterior of the compressor into the suction chamber 3.

The rotatable drive shaft 8 extends through the central boss 2*a* of the front side plate 2 and the central boss 4*a* of the front housing 4 and is rotatably supported by a bearing 2*c* at the central boss 2*a* and a bearing at the rear side plate (not shown). A shaft seal mechanism 9 is provided in the central boss 4*a* of the front housing 4 around the rotatable drive shaft 8, to seal the suction chamber 3 from the exterior of the compressor. It will be understood that the shaft seal mechanism 9 includes a lip-shaped seal member.

A check valve 13 is arranged in the front housing 3 at the inlet 4*a* to prevent a back flow of the fluid from the suction chamber 3 to the exterior of the compressor. The check valve 13 comprises a tubular valve body 15 extending radially of the front housing 4. The tubular valve body 15 is secured to the front housing 4 by a mounting tube 14 and has a tubular hollow wall, and a valve seat 15*b* is provided in the tubular valve body 15 close to the bottom of the mounting tube 14, and valve ports 15*a* are open laterally through the tubular hollow wall of the tubular valve body 15 inwardly adjacent to the valve seat 15*b*. In the illustrated embodiment, four valve ports 15*a* are provided at equidistant positions. A cup shaped valve member 16 is movably inserted in the tubular valve body 15 and engageable with the valve seat 15*b* to open or close the valve ports 15*a*, and a spring 17 urges the valve member 16 toward the valve seat 15*b*. The valve member 16 is moved to a lower position shown in FIGS. 1 and 2 to open the valve ports 15*a* when the compressor is operating, and to an upper position to close the valve ports 15*a* when the operation of the compressor is stopped, to prevent a back flow of the fluid, for example, a refrigerant, when the compressor is used in a refrigerating system.

A guide wall means is provided in the suction chamber 3 to guide the fluid from the check valve 13 toward the shaft seal mechanism 9. The guide wall means is integrally formed with the front housing in this embodiment, but a similar guide wall means can be formed integrally with the front side plate 2 or a similar guide wall means can be formed separately from and fixed to one of the front housing 4 and front side plate 2.

The illustrated guide wall means comprises a pair of guide walls 4*d* extending longitudinally from the inner wall 4*c* of the end wall of the front housing 4, as shown in FIG. 2, and radially on the opposite sides of the check valve 13, as shown in FIG. 1. The guide walls 4*d* also extend between the check valve 13 and the suction ports 11 and 12, and therefore the guide walls 4*d* constitute a passage therebetween for guiding the fluid from the check valve 13 radially centrally in the suction chamber 3 toward the shaft seal mechanism 9.

The central boss 4*a* of the front housing 4 projects from the end wall thereof into the suction chamber 3 to accommodate the shaft seal mechanism 9 therein, as shown in FIG. 2. The guide walls 4*d* extend generally radially between the projecting boss 4*a* and the valve ports 15*a*, i.e., the lower ends of the guide walls 4*b* preferably reach the projecting boss 4*a* and the upper ends of the guide walls 4*d* preferably extend beyond the lowermost portion of the valve ports 15*a*, to constitute the above-described passage.

The front side plate 2 has a pair of ribs or projections 2*b* extending longitudinally from the central boss 2*a* toward the shaft seal mechanism 9 at diametrically opposite positions about the rotatable drive shaft 8, to constitute a gap therebetween, the gap overlapping the passage between the pair of guide walls 4*b*. Therefore, the fluid can be guided to the shaft seal mechanism 9 continuously through the passage and the gap. The ribs 2*b* are shaped in arcs of a circle in cross section about the rotatable drive shaft 8, and the inner end of at least one of the guide walls 4*d* is spaced apart from the cooperating arcuate rib 2*b*, as shown in FIG. 1. The ribs 2*b* are integrally formed with the front side plate 2 and can be placed in contact with the shaft seal mechanism 9 to prevent the shaft seal mechanism 9 from moving toward the front side plate 2.

In operation, the fluid or the refrigerant in the refrigerating system is admitted into the suction chamber 3 through the valve ports 15*a* of the check valve 13 when the operation of the compressor is started. One of the major parts of the flow is represented by the arrow P, in which the fluid is guided along the lefthand guide wall 4*d* into the gap between the ribs 2*b* and toward the shaft seal mechanism 9, flows through the gap into the lower portion of the suction chamber 3, as shown by the arrow Q, and then is admitted into the compression working chamber 10 in the cylinder 1 during the suction stroke thereof through the suction port 12. Another part of the flow, which is guided along the righthand guide wall 4*d*, is reflected at the rotatable drive shaft 8 and the reflected part of the fluid passes through the gap between that guide wall 4*d* and the rib 2*b* into the suction chamber 3 near the suction port 11 and into the compression working chamber 10 in the cylinder 1 during the suction stroke thereof, as shown by the arrow R.

As described above, the majority of the fluid is supplied to the shaft seal mechanism 9, according to the present invention, and thus the shaft seal mechanism 9 can be sufficiently lubricated by the misty lubricant contained in the fluid to be compressed, so that an undesirable hardening or cracking of the organic seal material can be reduced and the lubrication and reliability of the seal improved.

We claim:

1. A vane type compressor comprising:

a main housing having a cylinder with a cylinder bore formed therein;

a front side plate covering one end of said cylinder bore, said front side plate having a central boss and at least one suction port for an admission to said cylinder bore of a fluid to be compressed;

a front housing mounted on said main housing at one end thereof over said front side plate and forming a suction chamber between said front housing and said front side plate, said front housing having an end wall with a central boss and a peripheral wall with an inlet formed therethrough for an admission of said fluid from the exterior of the compressor into said suction chamber;

a rotor inserted in said cylinder bore and secured on a rotatable shaft, said rotatable shaft extending through said central boss of said front side plate and said central boss of said front housing;

a check valve arranged in said front housing at said inlet to prevent a flow of said fluid from said suction chamber to the exterior of the compressor, said check valve comprising a tubular valve body extending radially of said front housing and having a tubular hollow wall, a valve seat in said tubular valve body, at least one valve port laterally opening through said tubular hollow wall adjacent to said valve seat, a valve member movably inserted in said tubular valve body and engageable with said valve seat to open or close said at least one valve port, and a spring urging said valve member toward said valve seat;

a seal means arranged in said central boss of said front housing around said rotatable shaft for sealing said suction chamber; and guide wall means provided in said suction chamber for guiding said fluid from said check valve toward said seal means, said guide wall means comprising a pair of guide walls extending longitudinally of said front housing radially on opposite sides of said check valve and between said check valve and said at least one suction port to constitute a passage therebetween for guiding said fluid from said check valve radially centrally in said suction chamber toward said seal means.

2. A vane type compressor according to claim 1, wherein said pair of guide walls extend from said end wall of said front housing.

3. A vane type compressor according to claim 2, wherein said central boss of said front housing projects from said end wall into said suction chamber and said guide walls extend radially between said projecting boss and said at least one valve port.

4. A vane type compressor according to claim 1, wherein said pair of guide walls extend from said front side plate.

5. A vane type compressor according to claim 2, wherein said front side plate has a pair of ribs extending longitudinally from said central boss thereof toward said seal means at diametrically opposite positions about said rotatable shaft to constitute a gap therebetween, said gap overlapping said passage between said pair of guide walls.

6. A vane type compressor according to claim 5, wherein said guide walls have respective inner ends spaced apart from said ribs.

7. A vane type compressor according to claim 6, wherein said ribs are shaped in arcs of a circle in cross section about said rotatable shaft.

* * * * *